United States Patent [19]

Roberts

[11] 4,038,834

[45] Aug. 2, 1977

[54] ICE SKATING ARENA

[76] Inventor: Richard Whitside Roberts, 23 Pearen Sreet, Toronto, Ontario, Canada

[21] Appl. No.: 621,091

[22] Filed: Oct. 9, 1975

[30] Foreign Application Priority Data

Oct. 11, 1974 Canada ..... 211317

[51] Int. Cl.[2] ..... A63C 19/10

[52] U.S. Cl. ..... 62/235; 52/64; 52/238; 272/3; 273/1 B

[58] Field of Search ..... 62/235; 272/3; 273/1 B; 52/64, 238

[56] References Cited

U.S. PATENT DOCUMENTS

| | | | |
|---|---|---|---|
| 3,107,400 | 10/1963 | Anderson | 52/238 X |
| 3,379,031 | 4/1968 | Lewis, Jr. | 62/235 |
| 3,683,100 | 8/1972 | Deal et al. | 52/64 X |
| 3,748,793 | 7/1973 | Tompkins et al. | 52/64 |
| 3,858,880 | 1/1975 | Graves | 272/3 X |

*Primary Examiner*—William E. Wayner
*Assistant Examiner*—William E. Tapolcai, Jr.
*Attorney, Agent, or Firm*—David M. Rogers

[57] ABSTRACT

An ice skating arena is described having a skating area arranged to define a plurality of individual ice rinks and interconnecting bridging sections. Cooling means are provided below the said ice skating area and are arranged to provide a continuous ice covering over said rinks and bridging sections in use. Barrier means are provided in association with each said bridging section. Each barrier means is adapted to be selectively positioned across the associated section or to be moved to a non-obstructing position to allow free skating over the section, whereby with all of the barrier means positioned across the associated sections, the individual rinks can be used as self-contained skating areas, or with all of the barriers moved to said non-obstructing positions, skaters can pass freely between the rinks by way of said bridging sections.

8 Claims, 7 Drawing Figures

40
42
54
56
~26~
36
40
56
~20~
48
54
52
34
~27~
52
54
30
48
54
~24~
50
56
50
48
56
40
~22~
40
32
44
42

44

38
~26~
40
62
~64~
58
62
40
62
~20~
38

ICE SKATING ARENA

This invention relates to an ice skating arena.

An object of the invention is to provide an arena which can be adapted for different skating activities.

According to the invention there is provided an ice skating arena having a skating area arranged to define a plurality of individual ice rinks and interconnecting bridging sections. Cooling means are provided below said ice skating area and are arranged to provide a continuous ice covering over said rinks and bridging sections in use. Barrier means are provided in association with each said bridging section. Each barrier means is adapted to be selectively positioned across the section or to be moved to a non-obstructing position to allow free skating over the section, whereby, with all of the barrier means positioned across the associated sections, the individual rinks can be used as self-contained skating areas, or with all of the barrier means moved to said non-obstructing positions, skaters can pass freely between the rinks by way of said bridging sections.

The invention will be better understood by reference to the accompanying drawings in which.

Figure 1:
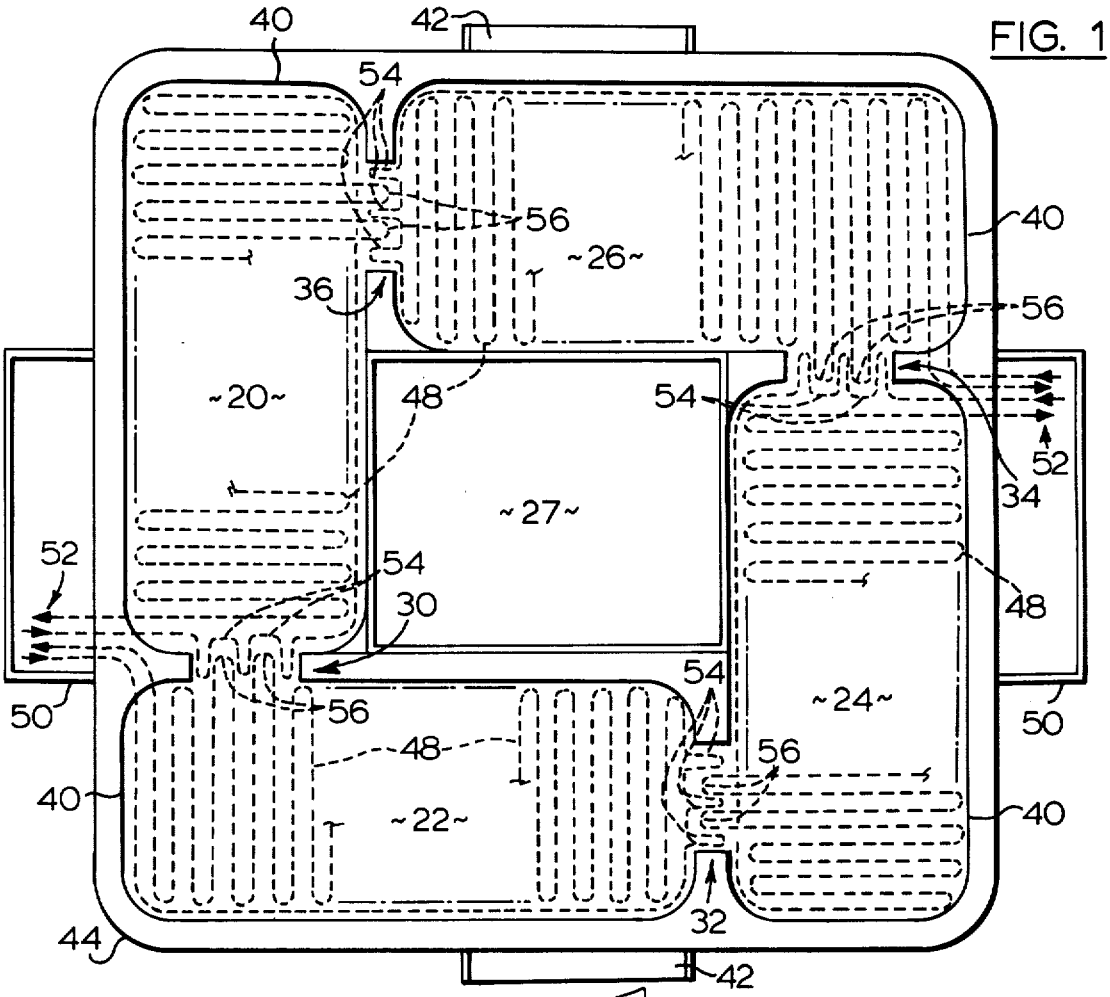
FIG. 1 is a ground floor plan view of an ice skating arena according to the invention.

The arena illustrated in FIGS. 1 to 6 is of the indoor type and is housed in a two storey building, the ground floor plan of which is shown in FIG. 1. An ice skating area is provided on the ground floor and the upper floor (see FIG. 2) is intended to be used by spectators to view the ice skating area as will be described. The ice skating area is arranged to define four individual ice rinks denoted 20, 22, 24 and 26 arranged seriatim around a central area 27. Area 27 is occupied by a structure 28 (see FIG. 2) which, at ground floor level, includes change rooms, a shop, a snack bar and seating accommodation for people using the arena.

Figure 3:
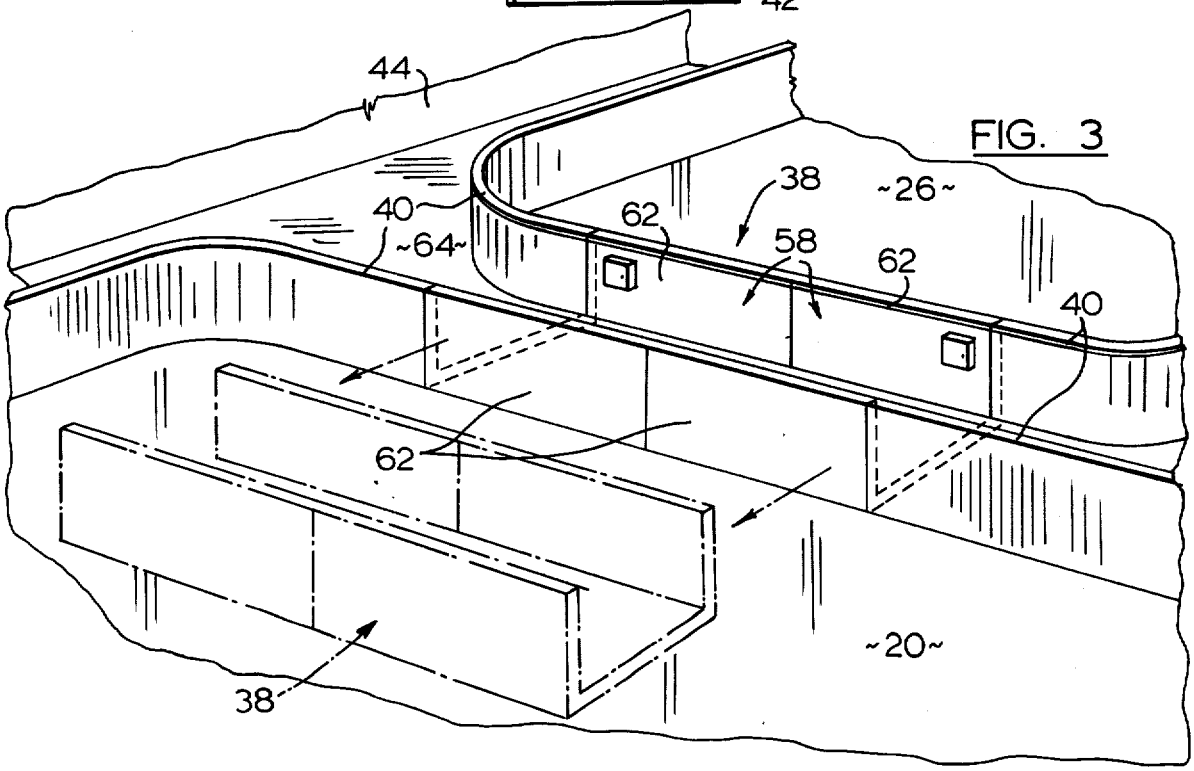
FIG. 3 is a perspective view corresponding to part of FIG. 1 and showing the removable barrier between two adjacent ice rinks.

As can be seen from FIG. 1, the four ice rinks, 20, 22, 24 and 26, are of rectangular form with rounded corners and are arranged in a square configuration. The ice skating area includes bridging sections 30, 32, 34 and 36 which extend between one end of each rink and the side of an adjacent rink. Removable barriers, one of which is indicated diagrammatically at 38 in FIG. 3 are provided and can be positioned over the sections 30, 32, 34 and 36 so that the rinks 20, 22, 24 and 26 become individual self-contained skating areas. When removed, the barriers allow access between the rinks, permitting uninterrupted free skating over the whole ice skating area by way of the said bridging sections.

In this particular embodiment, the ice rinks 20, 22, 24 and 26 are intended to be used primarily as individual hockey rinks when the barriers are in place. The rinks are therefore dimensioned accordingly. Further, each rink is surrounded by "boards" 40 (see FIGS. 2 and 3) such as are conventionally found around a hockey rink. The boards are interrupted at the positions of the said bridging sections 30, 32, 34 and 36 and removable barriers such as that indicated at 38 in FIG. 3 are adapted to be fitted into the gaps in the boards as will be described.

In FIG. 1, the main entrances to the arena are denoted 42 and it will be noted that the people entering the arena have access to walkways defined between the boards 40 and the walls 44 of the arena. When the removable barriers such as 38 are in position, spectators can, accordingly, walk all around each of the four rinks and also gain access to the centre structure 28 (FIG. 2).

Figure 2:
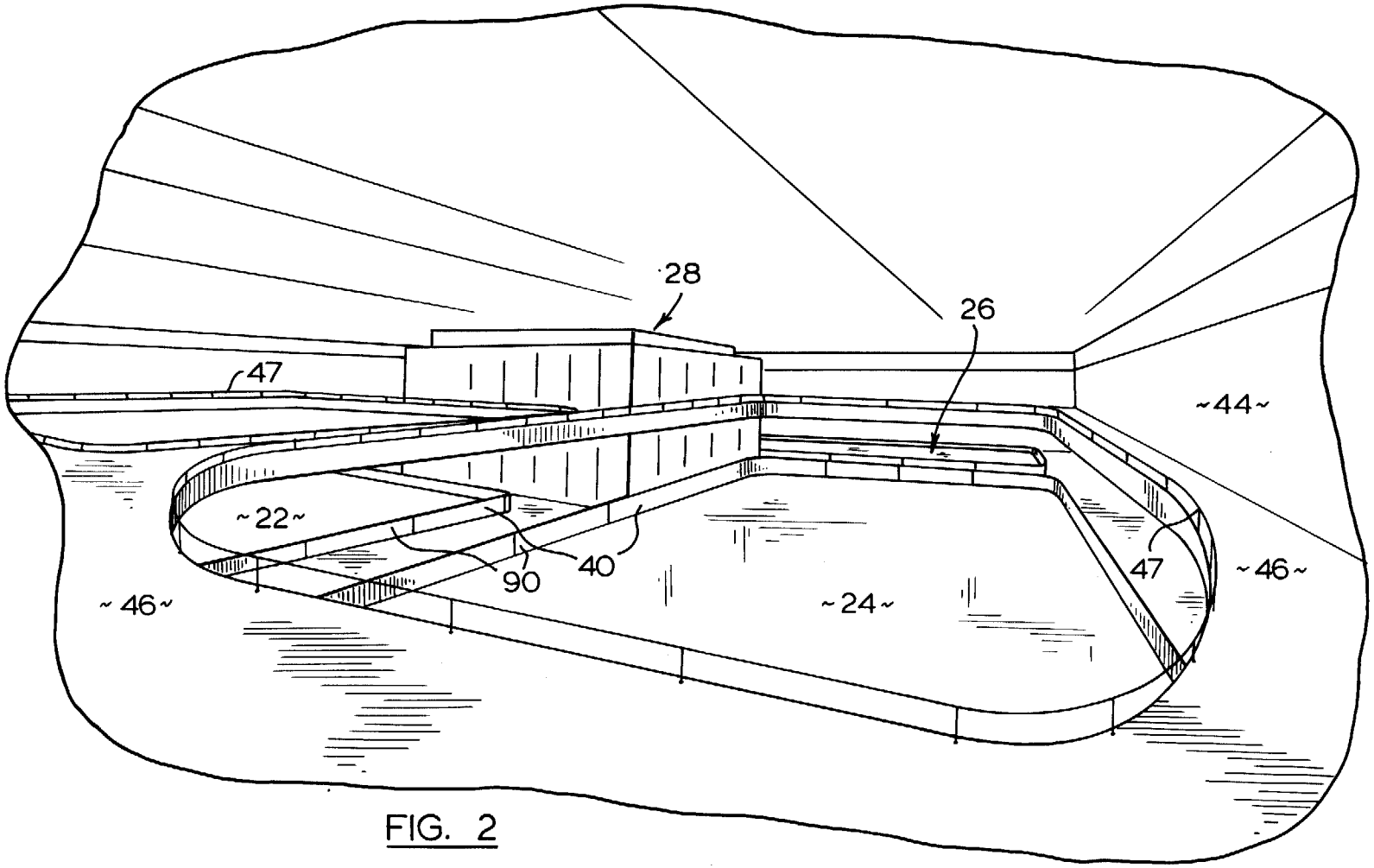
FIG. 2 is a perspective view of part of the upper floor of the arena.

The upper floor of the area can be seen in FIG. 2. Access between the two floors is by way of stairways in the central structure 28. The upper floor of the central structure may contain lounges, dining rooms, observation rooms, administration areas and toilets. It will be noted that the upper floor of the arena is shaped to form walkways 46 which generally follow the shape of the walkways on the ground floor. Railings 47 are provided around the inner sides of the walkways to allow spectators on the upper floor to view people on the ice below.

Referring back to FIG. 1, the floors of the individual ice rinks are constructed in conventional fashion and have embedded therein cooling pipes 48 containing refrigerant for forming the ice. Structures 50 built onto the outside walls of the arena house refrigeration equipment to which the cooling pipes are connected. It will be noted that two sets of refrigeration equipment are provided, one at each side of the building, and that each set of equipment serves the two rinks nearest to it. The fact that the refrigeration equipment is located externally of the building housing the arena reduces the risk of injury to persons using the building and of damage to its interior in the event of a malfunction of the equipment. The floor of each rink is cooled by a single pipe 48 arranged in a convoluted path as shown in the drawings, through which refrigerant is pumped in the direction indicated by the arrows 52. It will be noted that the portion of each pipe 48 along which the refrigerant is first pumped on leaving the refrigeration equipment extends around part of the periphery of the rink and is shaped to define three elongate loops 54 disposed below the relevant bridging sections 30, 32, 34 or 36 of the ice surface between the rink in question and the adjacent rink. These loops 54 co-operate with extended portions 56 of the transverse convolutions of the cooling pipe in the adjacent rink to ensure that ice is formed across the bridging section between the two rinks.

Figure 4:
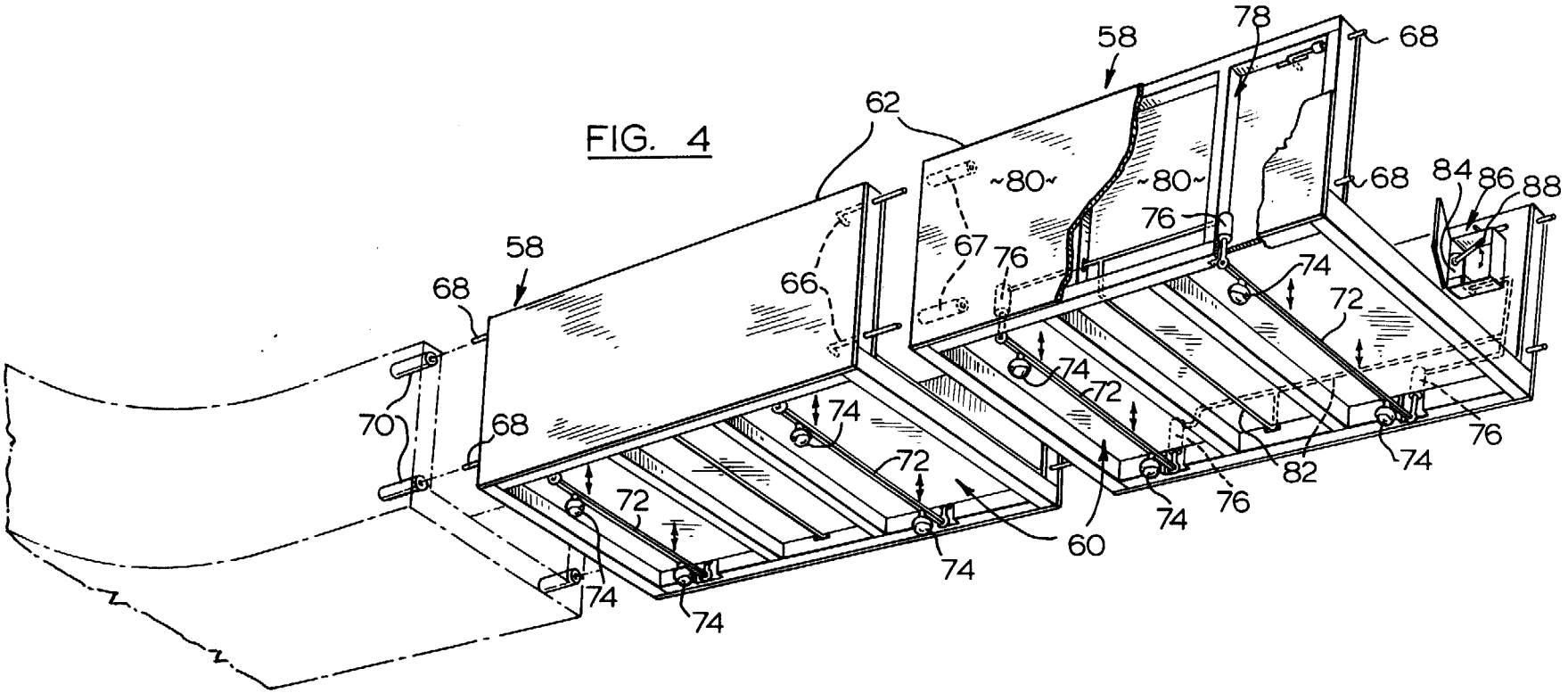
FIG. 4 is an underneath perspective view of the barrier shown in FIG. 3.
Figure 6:
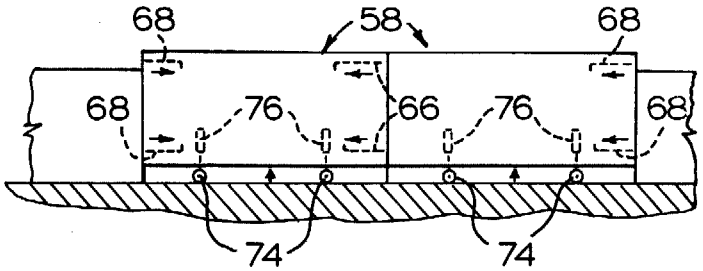
FIGS. 5 and 6 are diagrammatic side views of the barriers shown in FIGS. 3 and 4 and illustrate the way in which the barriers are removed.
Figure 5:
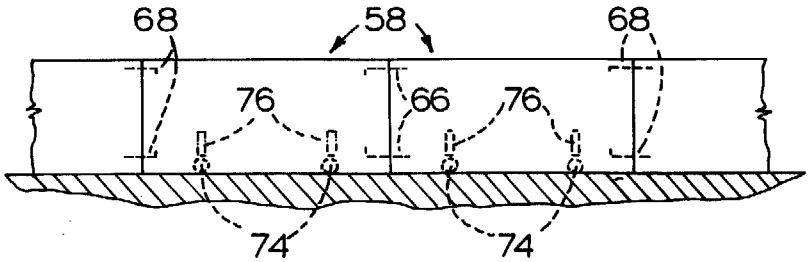

One of the removable barriers 38 will now be described with reference to FIGS. 3, 4, 5 and 6. Each barrier is formed by two sections 58, each of U-shape in cross-section. The sections 58 each have a base 60 and two sides 62. When the barriers are in use, the sections 58 are positioned end to end with their bases 60 resting on the ice in the relevant bridging section between the two rinks. The level of the floor 64 (FIG. 3) of the walkway around the rink is above the level of the ice and flush with the top surfaces of the bases 60 of the sections 58. Referring now more particularly to FIGS. 4 to 6, bolt and socket couplings are provided between the abutting ends of the sections 58. Each section carries at each side of its inner end two sliding bolts 66 which are received in complementary sockets 67 on the other section. Each section is also provided at its outer end with four sliding bolts 68 which can be projected into corresponding sockets 70 carried by the boards 40. Two transverse bars 72 are positioned below the base 60 of each section 58 and each bar carries swivel casters 74 adjacent respectively opposite ends thereof. The bars can be moved between retracted positions in which the casters are above the lower edges of the sides 62 of the sections and lowered positions in which the casters project below the lower edges of the said side 62 to support the sections clear of the ice. Each bar 72 is carried at its ends by hydraulic actuactors 76 in the form of piston and cylinder units mounted in vertical positions inside the side walls 62 of the sections. It will be noted that each side wall is formed by a wooden frame 78 covered on each side by boards 80. The base 60 of the sections is of similar constructions. The actuactors 76 are mounted on the frame 78 and are interconnected by pipework 82. The pipework is connected to a manually operable pump 84 mounted in an enclosure 86 of the inside surface of one of the side walls 62 of the section 58. A similar arrangement (not shown) is provided on the other section.

Referring now more particularly to FIGS. 5 and 6, FIG. 5 shows the barrier sections 58 in the positions they occupy when fitted to the boards 40 around the individual ice rinks; with the barriers in this position, the rinks can be used as individual self-contained skating areas. At this time, the pistons of the hydraulic actuactors 76 are retracted so that the caster wheels 74 are withdrawn above the lower edges of the sides 62 of the sections 58 and the sections rest on the said edges. Retraction of the pistons of the actuactors is effected by releasing a valve in the pump 84 by turning its handle 88; the section then lowers under its own weight. In the condition of FIG. 5, the coupling 66 between the sections are engaged and the bolts 68 at the outer ends of the respective sections are engaged in the socket 70 in the boards 40.

When the barrier formed by the two sections 58 is to be removed, the bolts 66 between the two sections and the bolts 68 at their ends are withdrawn as indicated by the arrows in FIG. 6. Assuming the release valves on the pumps 84 of the two sections are closed, each pump is then operated in turn to operate the actuactors 76, thereby lifting the sections 58 on the caster wheels 74 until the sections are clear of the ice. Each section can then be wheeled away on its caster wheels into a storage area. Hinged doors 90 (FIG. 2) are provided in the boards 40 around the respective rinks 20, 22, 24 and 26 to provide access between the rinks and the central structure 28 of the arena. The sections 58 can accordingly be moved into and from a storage area in the structure 28 by way of the doors 90.

When all of the barriers between the ice rinks have been removed, the whole ice skating area can be used for free skating. If the rinks are required to be used individually, e.g., for hockey matches, the barriers formed by the sections 58 are replaced by reversing the sequence of operations described above.

Figure 7:
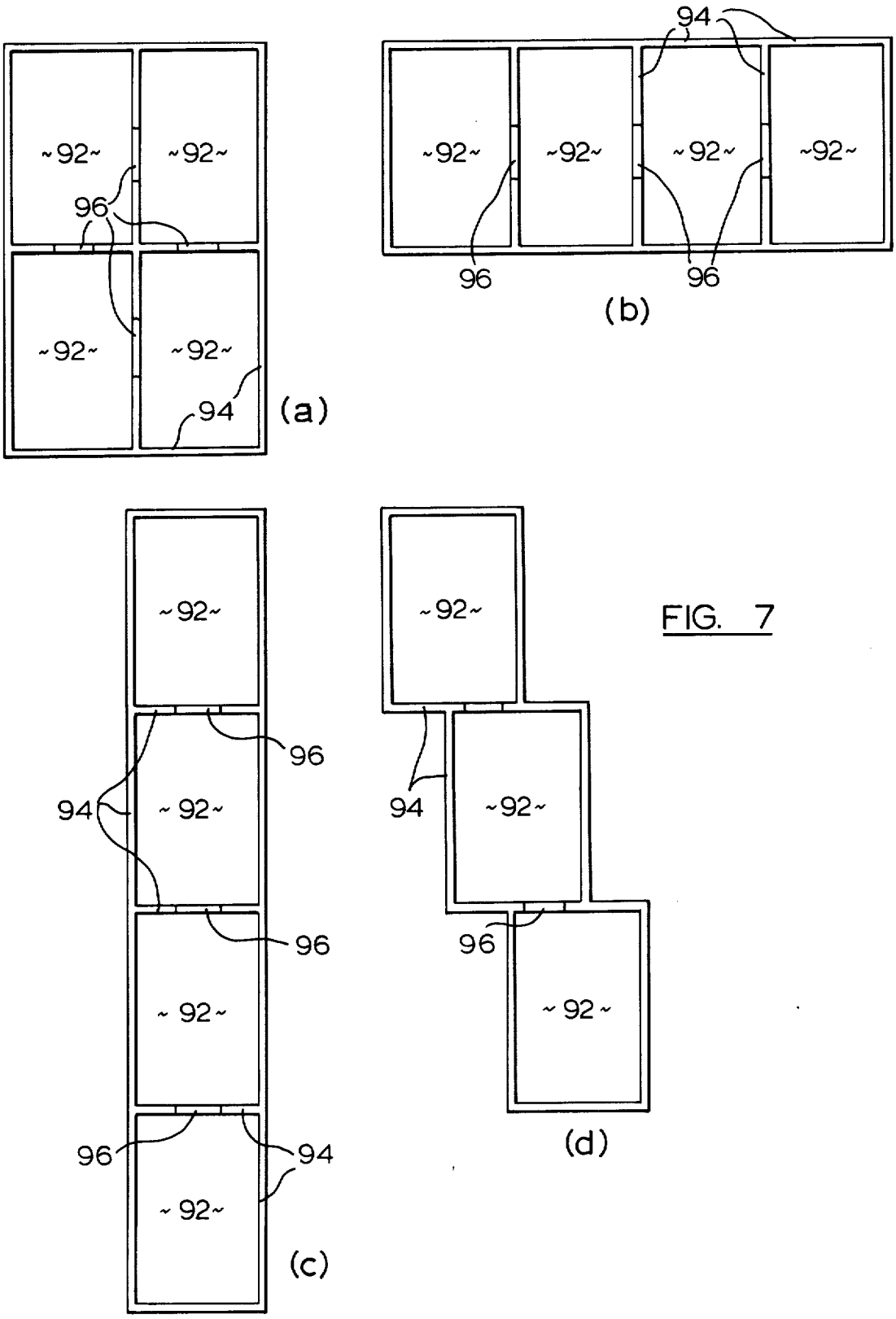
FIG. 7 includes four diagrammatic plan views showing alternative floor plans for ice skating arenas according to the invention.

Reference will now be made to FIG. 7 which shows four different ice rink arrangements which may be employed in an arena according to the invention. In each case, the arena includes a plurality of rectangular ice rinks, each of which is denoted 92 and each of which is surrounded by barriers or boards 94. Removable barrier sections 96 are provided in the boards to provide access between the rinks in similar fashion to the previous embodiment. Bridging sections of the ice skating area extend between the rink 92 below the removable barriers 96. Cooling pipes are provided below the bridging sections, as well as below the surfaces of the ice rinks to produce a continuous ice covering over the skating area.

The barrier sections may be constructed in similar fashion to those described in connection with FIGS. 1 to 6. In this event, walkways will be provided around and between the individual rinks. In any event, in all of the examples shown in FIG. 7, the rinks 92 can be used individually when the barriers 96 are in place, or the barriers can be removed and the ice skating area used for free skating between the rinks.

Although the rinks have been shown in FIG. 7 as of rectangular shape, it is to be understood that they may be provided with rounded corners, as in the embodiment of FIGS. 1 to 6. Further, each rink may be of any overall shape within the broad scope of the invention.

It will be appreciated that the preceding description applies to specific embodiments of the invention and that many further variations are possible within the broad scope of the invention. For example, the individual rinks could be defined by barriers appropriately positioned on a continuous frozen surface. Further, the removable barriers 38 may take a variety of forms. In one embodiment, the removable barriers could be mounted at their ends in vertical guides and power means could be provided to lift the barriers vertically in the guides. In another example, each barrier may be carried by a pivoted gantry which may be counterbalanced so that the barrier can be swung out of its obstructing position to an overhead position during free skating.

Alternatively, each barrier could be pivotable about a vertical axis at its centre so as to be turnable between a first position in which it closes the relevant gap in the boards and a second position at right angles to the first position. In the second position, skaters would pass the barrier on opposite sides thereof.

In a still further, simple embodiment, the removable barriers may be formed by flat panels which are locked into the gaps in the boards and are removable by hand. In this case, a separate, manually removable base would have to be provided to cover the interconnecting strip of ice between the two rinks.

Further modifications may be envisaged in connection with the ice forming equipment of the arena. For example, the refrigeration equipment in the housing 50 may include provision for passing heated liquid along the pipes 48 to assist in rapid melting of the ice during servicing of the arena. Alternatively, electric heating coils may be provided around the pipes. Further, a layer of insulating material such as Styrofoam particles may be provided below the cooling tubes 48 to prevent the cooling effect of the tubes penetrating the ground therebelow. Baffles may also be provided below the ice to reduce the noise produced by skaters.

It should further be noted that although in the preceding description reference has been confined to an indoor ice skating arena, the invention may also be applied to an arena of the outdoor type.

What I claim is:

1. An ice skating arena having:

a skating area arranged to define a plurality of individual ice rinks arranged in seriatim around a central area, and interconnecting bridging sections arranged to permit skaters to circulate around said central area by way of the rinks and bridging sections;

cooling means disposed below the said skating area and arranged to provide a continuous ice covering over said rinks and bridging sections in use; and, in association with each said bridging section, barrier means adapted to be selectively positioned across the section or to be moved to a non-obstructing position to allow free skating over the section, whereby, with all of the barrier means positioned across the associated sections, the individual rinks can be used as self-contained skating areas or, with all of the barriers moved to said non-obstructing positions, skaters can pass freely between the rinks by way of said bridging sections.

2. An ice skating arena as claimed in claim 1, having four individual ice rinks, each of generally rectangular shape, the rinks being arranged in a square configuration with one end of each rink disposed parallel to and spaced from part of a side of an adjacent rink.

3. An ice skating arena as claimed in claim 2, wherein each said rectangular rink is of the shape and size of a hockey rink, and is surrounded by boards of the kind conventionally located around hockey rinks, the boards having, at the positions of each of said bridging sections of the skating area, a gap to receive one of the said barrier means.

4. An ice skating arena as claimed in claim 1, wherein the said cooling means comprises cooling pipes which are embedded in the floors of the rinks and refrigeration equipment connected to said pipes for circulating refrigerant therethrough, the pipes being arranged so that each said bridging section of the ice skating area is cooled by portions of the cooling pipes below each of the rinks at opposite ends of the said section.

5. An ice skating arena having:

a skating area defining: a plurality of individual ice rinks arranged in seriatim around a central area, the individual rinks being spaced from one another to provide walkways there between; and interconnecting bridging sections arranged to permit skaters to circulate around said central area by way of the rinks and bridging sections; each of said rinks being of the shape and size of a hockey rink and being surrounded by boards of the kind conventionally located around hockey rinks, the boards defining a gap at the position of each of said bridging sections of the skating area;

cooling means disposed below the said ice skating area and arranged to provide a continuous ice covering over said rinks and bridging sections in use; and, in association with each said bridging section, barrier means adapted to be selectively positioned across the section or to be moved to a non-obstructing position to allow free skating over the section, whereby, with all of the barrier means positioned across the associated sections, the individual rinks can be used as self-contained skating areas or, with all of the barriers moved to said non-obstructing positions, skaters can pass freely between the rinks by way of said bridging section; each said barrier means comprising a generally U-shaped structure having flat elongate sides, each of which is adapted to fit into and close the gap in the boards around one of the rinks, while the other side of the structure is adapted to fit into and close the gap in the boards of an adjacent rink, the portion of the structure beween said side forming part of said walkways between the rinks and the structure being adapted to be releasably locked to the boards in use.

6. An ice skating arena as claimed in claim 5, wherein each of said structures comprises two similar sections which are positioned end to end in use and wherein the sections are provided with sliding bolts on one section adapted to be received in complementary sockets on the other for releasably coupling the sections, and wherein locking means are provided to couple the sections to the boards, said means comprising similar sliding bolts on one end of the sections and the boards and complementary sockets on the other of the sections and the boards.

7. An ice skating arena as claimed in claim 5, wherein each of said structures is provided on its underside with means for elevating the structure to a position clear of the surface of the ice, and with caster wheels coupled to said elevating means so that the wheels are moved down into contact with the ice when the elevating means are operated, whereby the structure is supported on said caster wheels in an elevated position for transportation purposes.

8. An ice skating arena as claimed in claim 7, wherein said elevating means comprise hydraulic actuactors carried by the structure and coupled to said caster wheels, and hydraulic pump means carried by said structure and connected to the actuactors, whereby operation of the pump means to supply hydraulic fluid to the actuactors causes the caster wheels to be projected below the structure to lift the same clear of the ice.

* * * * *